US008778202B2

(12) United States Patent
Bumgardner

(10) Patent No.: US 8,778,202 B2
(45) Date of Patent: Jul. 15, 2014

(54) SPREADING INK OVER A PRESS PLATE USING A HEATER

(75) Inventor: Patrick Lee Bumgardner, Chesnee, SC (US)

(73) Assignee: Kings Mountain International, Inc., Kings Mountain, NC (US)

( * ) Notice: Subject to any disclaimer, the term of this patent is extended or adjusted under 35 U.S.C. 154(b) by 172 days.

(21) Appl. No.: 13/242,794

(22) Filed: Sep. 23, 2011

(65) Prior Publication Data

US 2013/0075363 A1 Mar. 28, 2013

(51) Int. Cl.
*B44C 1/22* (2006.01)

(52) U.S. Cl.
USPC ..... 216/48; 216/27; 216/41

(58) Field of Classification Search
USPC ..... 216/48, 41, 27
See application file for complete search history.

(56) References Cited

U.S. PATENT DOCUMENTS

| | | | | |
|---|---|---|---|---|
| 4,052,217 | A * | 10/1977 | Watkinson | 430/166 |
| 4,873,134 | A | 10/1989 | Fulton et al. | |
| 5,105,204 | A | 4/1992 | Hoisington et al. | |
| 6,849,308 | B1 * | 2/2005 | Speakman et al. | 427/595 |
| 7,360,885 | B2 | 4/2008 | Hirai | |
| 7,538,149 | B2 | 5/2009 | Aoai | |
| 2007/0068898 | A1 * | 3/2007 | Lorenz | 216/27 |
| 2010/0103235 | A1 | 4/2010 | Roof et al. | |
| 2010/0177151 | A1 | 7/2010 | Thompson et al. | |
| 2011/0102525 | A1 | 5/2011 | Larson et al. | |
| 2011/0262765 | A1 * | 10/2011 | Yu et al. | 428/600 |
| 2012/0320117 | A1 * | 12/2012 | Roof et al. | 347/9 |
| 2013/0033549 | A1 * | 2/2013 | Barton et al. | 347/84 |

FOREIGN PATENT DOCUMENTS

| | | |
|---|---|---|
| EP | 2412516 | 2/2012 |
| WO | WO2006/066776 | 6/2006 |
| WO | WO2011/039665 | 4/2011 |
| WO | WO2011/141849 | 11/2011 |

OTHER PUBLICATIONS

EP Search Report for EP12185205, dated Jan. 28, 2013.

* cited by examiner

*Primary Examiner* — Duy Deo
*Assistant Examiner* — Mahmoud Dahimene
(74) *Attorney, Agent, or Firm* — W. Kevin Ransom; Moore & Van Allen PLLC

(57) ABSTRACT

This invention relates to methods and apparatuses for creating a textured press plate by spreading ink over the press plate using a heater. Some embodiments provide a method that includes: (a) dispensing radiation-curable ink onto a press plate; (b) spreading the ink over the press plate by heating the ink; and (c) irradiating the ink so that the ink is at least partially cured and/or fixed, and/or such that the spreading of the ink is at least partially slowed and/or stopped. In some embodiments, the irradiating the ink occurs after the spreading the ink. In other embodiments, the ink acts to resist a chemical solution, and the method further includes etching a surface portion of the press plate by exposing the portion to a chemical solution, where the surface portion includes the ink, and where the etching the surface portion occurs after the irradiating the ink.

13 Claims, 11 Drawing Sheets

SPREADING INK OVER A PRESS PLATE USING A HEATER

BACKGROUND

Decorative laminates have been used as surfacing material for many years, in both commercial and residential applications. Decorative laminates can provide an aesthetically pleasing surface that is more economical and/or has improved physical characteristics compared to similar looking alternatives. For example, decorative laminates can be used to create flooring that has the appearance of real hardwood flooring but is less expensive and more durable than real hardwood flooring.

In addition to flooring, decorative laminates are often used in furniture, countertops, cabinets, wall paneling, partitions, fixtures, and the like. As described above, decorative laminates can be made to resemble real wood. Decorative laminates can also be made to resemble such other materials and surfaces as stone, ceramic, marble, concrete, leather, fabric, brick, tile, and the like. In other applications, instead of being made to resemble a particular traditional material or surface, a decorative laminate may be made to provide more fanciful surfaces.

More recently, decorative laminates have been improved to include a three-dimensional "textured" surface. In this way, decorative laminates can be made to not only look like some other material or surface, but can also be made to feel like the other material or surface. In fact, decorative laminates can be made to so closely resemble the look and feel of other materials that one cannot easily determine whether the surface includes the real materials or is a faux representation of the real materials. For example, a textured decorative laminate made to look like real wood paneling may include a plurality of depressions and/or protrusions on its surface to create a texture that simulates the grains and knots of real wood boards. In another example, the textured decorative laminate may be made to look like a plurality of ceramic tiles separated by grout lines. In such an embodiment, the surface of the laminate may be made so that the images of the grout lines are depressed relative to the images of the ceramic tiles. In still other applications, textured decorative laminates may be made with more fanciful virtual artwork and may have embossing and textures that work in conjunction with the virtual artwork to create a more interesting and aesthetically pleasing surface.

In general, decorative laminates are classified into two broad categories based on how the laminates are manufactured, namely "high" pressure decorative laminates (HPDLs) and "low" pressure decorative laminates (LPDLs). In general, the industry considers "high" pressure decorative laminates as those laminates that are manufactured or "laminated" under a pressure of generally more than 750 psig. "Low" pressure decorative laminates are typically manufactured at a pressure of about 300 to 600 psig.

HPDLs and LPDLs are often further distinguished by the fact that HPDLs are typically manufactured by first laminating a decorative paper layer with one or more other thin layers and a resin to create a relatively thin and flexible laminate. This thin and flexible laminate is then typically adhered to a thicker, self-supporting substrate layer during a later stage of manufacturing. In contrast, LPDLs are typically manufactured by laminating the decorative paper layer with the self-supporting substrate layer, such as particleboard or MDF, and a resin in a single laminating or "pressing" operation during its manufacture. Generally, the idea is that the higher pressures involved in manufacturing HPDLs may "crush" the substrate layer. For this reason, LPDLs are sometimes also referred to as "direct" pressure decorative laminates (DPDLs) since the decorative layer is laminated or "pressed" directly onto the core layer in a single step. However, it should be noted that, although manufacturing HPDLs typically involves the two steps described above while manufacturing LPDLs typically involves the one step described above, this is merely a generalization about the typical manufacturing processes used to make the two different types of laminates. In some procedures, an HPDL may be laminated with a self-supporting substrate layer in a single pressing step and a LPDL may be adhered to a substrate layer in more than one step.

FIG. 1 illustrates an exemplary physical LPDL 5 and press system 1, in accordance with an embodiment of the present invention. As illustrated in FIG. 1, the laminate 5 generally comprises a decorative layer 6 (sometimes referred to as a "décor") and a substrate layer 8. The decorative layer 6 is typically a physical sheet of paper or similar material having a decorative image or pattern printed thereon. The substrate layer 8 is used to provide structure to the laminate and may be, for example, particleboard, high-density fiberboard (HDF), medium-density fiberboard (MDF), or the like. The decorative layer 6 is soaked with resin, such as a melamine formaldehyde resin, and is bonded to the substrate layer 8. In some embodiments, one or more other layers are bonded with the decorative layer 6 and the substrate layer 8. For example, a substantially transparent wear resistant layer 12 may be bonded over top of the decorative layer 6 to protect the "top" surface of the final laminate. Likewise, a base layer 10 may be bonded to the lower surface of the substrate to protect the "bottom" surface of the final laminate.

As illustrated in FIG. 1, these layers are at least partially coated or saturated with resin and placed in a press 2 where they are bonded together under heat and pressure. For example, the layers are typically heated to approximately 160 to 220 degrees Celsius and pressed together at approximately 300 to 400 psi for approximately 15 to 20 seconds. The heat cures the thermosetting resin, thereby bonding the layers together. For textured decorative laminates, the upper portion of the press 2 typically has a press plate 4 attached thereto, where the press plate 4 has a plurality of depressions and/or protrusions arranged in a three-dimensional design. When the press plate 4 is physically pressed into the resin and against the upper surface of the laminate, the resin on the upper surface cures with an imprint of the three-dimensional surface of the press plate 4 therein. The press 2 may also include a lower press plate 3 attached thereto. The lower press plate 3 may have a flat, smooth surface or, in some embodiments, may have a plurality of depressions and/or protrusions arranged in a three-dimensional design so that the lower surface of the laminate is imprinted in addition to or as an alternative to the upper surface of the laminate.

A system for generating HPDLs may, in some cases, be similar to the LPDL system shown in FIG. 1. The pressures, and often temperatures, however, will generally be significantly higher in an HPDL system. Although the layering in an HPDL may be different, the manufacture of textured HPDLs still generally involves use of a press, a textured press plate, a decorative layer, and a thermosetting polymeric resin.

Typically, the party that manufactures the laminate has another party create the textured press plate(s) used in the manufacturing process. Since the press plates must be able to withstand significant and repetitive heat and pressure changes and since the press plates must typically have very detailed and precise texture patterns formed of many minuscule depressions and/or ridges in the press plate, the manufacturer of the press plate is typically a company that specializes in the manufacture of precision metal plates. Although the laminate manufacturer, and perhaps the end user of the laminate, generally decide on what will be a suitable texture for the resulting laminate, the press plate manufacturer is also usually involved in the design of the texture since the press plate company typically has significant knowledge of which textures are possible and at what cost different textures can be made.

To create a textured press plate, the press plate manufacturer typically obtains a rigid substrate and then precision grinds that substrate until the substrate is substantially flat. Thereafter, the manufacturer prints a selected texture design onto the substrate to guide a subsequent etching process. Once the design is properly printed, the manufacturer will etch various surface portions of the substrate based on the printed design to create a three-dimensional surface thereon. The result of this etching transforms the substrate into a textured (e.g., three-dimensional) press plate that can be used to produce textured decorative laminates.

Unfortunately, these printing and etching processes are very costly in terms of time, money, and effort. Indeed, it may take a press plate manufacturer as long as eight hours to properly print a relatively decorative design onto a press plate. In addition, several iterations of the printing and etching may be required to produce the textured press plate. As a result, press plate manufacturers are constantly looking for new and useful ways to reduce the time and effort required to properly print and etch a press plate.

SUMMARY OF SELECTED EMBODIMENTS OF THE PRESENT INVENTION

The following presents a simplified summary of the present disclosure in order to provide a basic understanding of some aspects of the invention. This summary is not an extensive overview of the invention. It is not intended to identify key or critical elements of the invention or to delineate the scope of the invention. The following summary merely presents some concepts of the invention in a simplified form as a prelude to the more detailed description provided below.

In general terms, embodiments of the present invention relate to methods and apparatuses for creating a textured press plate, and more specifically, for creating a textured press plate by spreading ink over the press plate using a heater. In some embodiments, this heating and spreading of the ink enables a press plate manufacturer to cut in half the time required to properly print a design onto a press plate, thereby significantly reducing the time, effort, and cost required to create a textured press plate that can be used to produce textured decorative laminates.

Some embodiments of the present invention provide a method that includes: (a) dispensing radiation-curable ink onto a substrate (e.g., a press plate); (b) spreading the ink over the substrate by heating the ink (e.g., using an infrared (IR) heater); and (c) irradiating the ink (e.g., using an ultraviolet (UV) radiation source) such that the ink is at least partially cured and/or fixed onto the substrate. In some of these embodiments, the ink is at least partially cured after being heated and/or spread over the substrate. Additionally or alternatively, in some embodiments, the ink is irradiated no later than approximately 500 milliseconds after the ink is heated (e.g., the ink is irradiated approximately 380 milliseconds after being heated).

Other embodiments of the present invention provide an apparatus that includes: (a) a platform configured to at least partially support a substrate thereon; and (b) a print assembly positioned over the platform and including: (i) an ink dispenser (e.g., an inkjet printer) configured to dispense radiation-curable ink onto the substrate; (ii) a heater configured to heat the ink such that the ink spreads over the substrate; and (iii) a radiation source configured to irradiate the ink such that the spreading of the ink over the substrate is at least partially slowed and/or stopped.

Still other embodiments of the present invention provide a method for creating a textured press plate that can be used to produce textured decorative laminates. In some of these embodiments, the method includes: (a) printing a design on the press plate, where the printing includes: (i) dispensing ink onto the press plate, where the ink at least partially gels after the ink comes into contact with the press plate; and (ii) heating, using a heater, the ink until the ink spreads over the press plate; and (b) etching a surface portion of the press plate by exposing the portion to a chemical solution (e.g., a ferric chloride solution), where the surface portion includes the ink, and where the etching the surface portion occurs after the heating the ink.

BRIEF DESCRIPTION OF THE FIGURES

Figure 1:
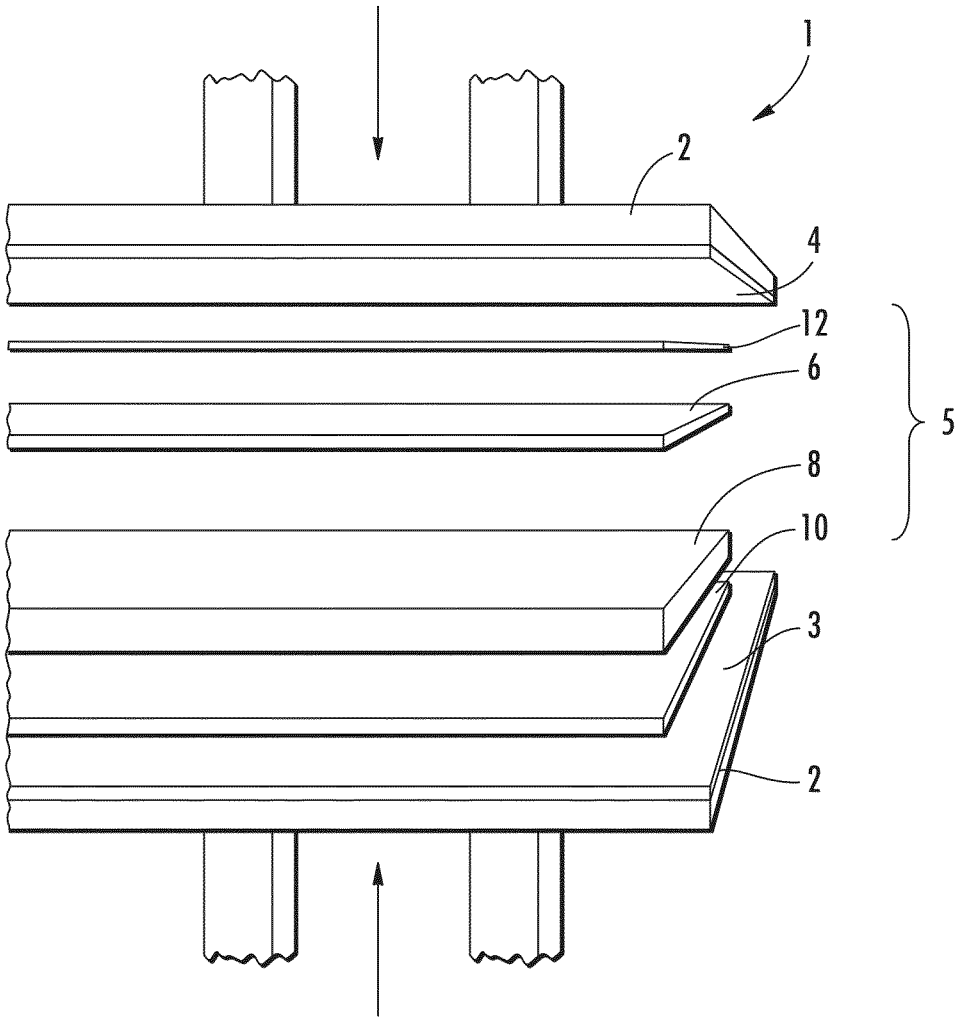
Figure 2:
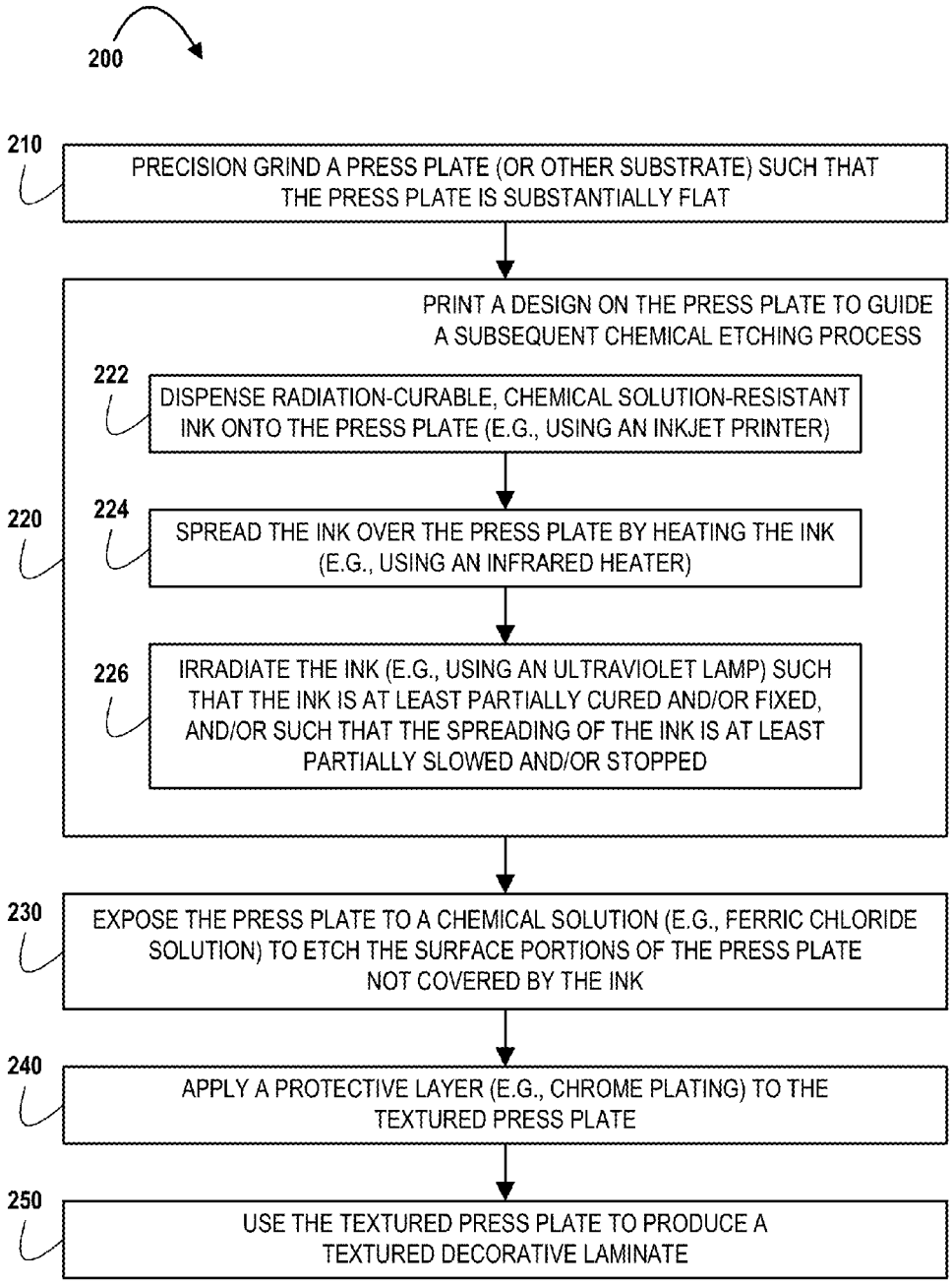
Figure 3:
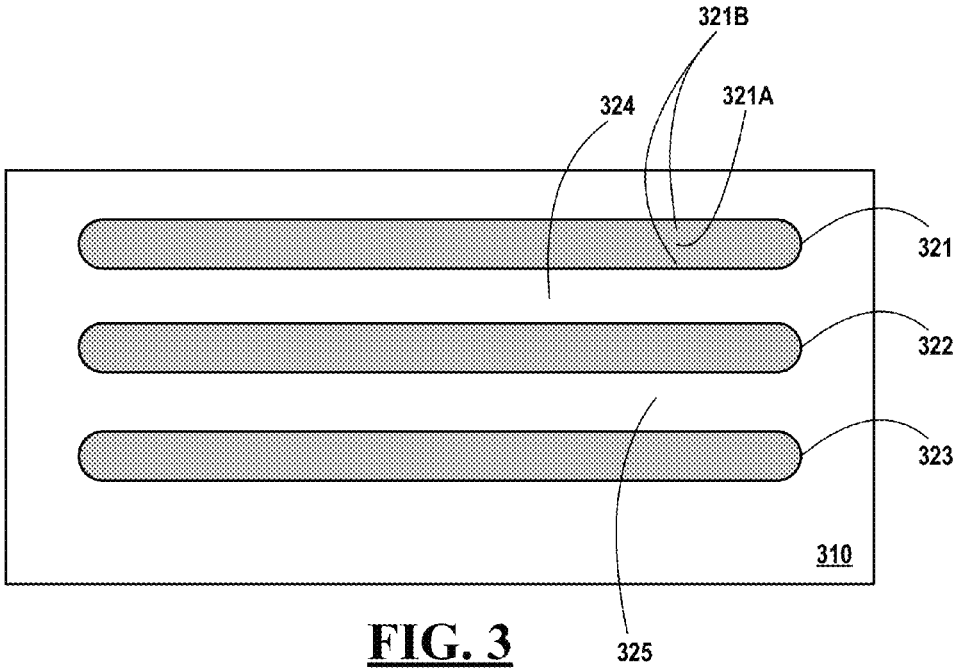
Figure 3A:
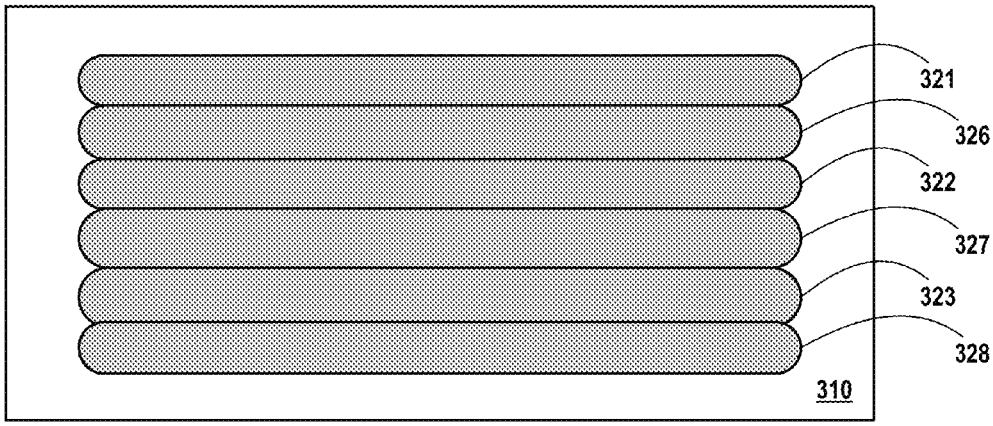
Figure 4:
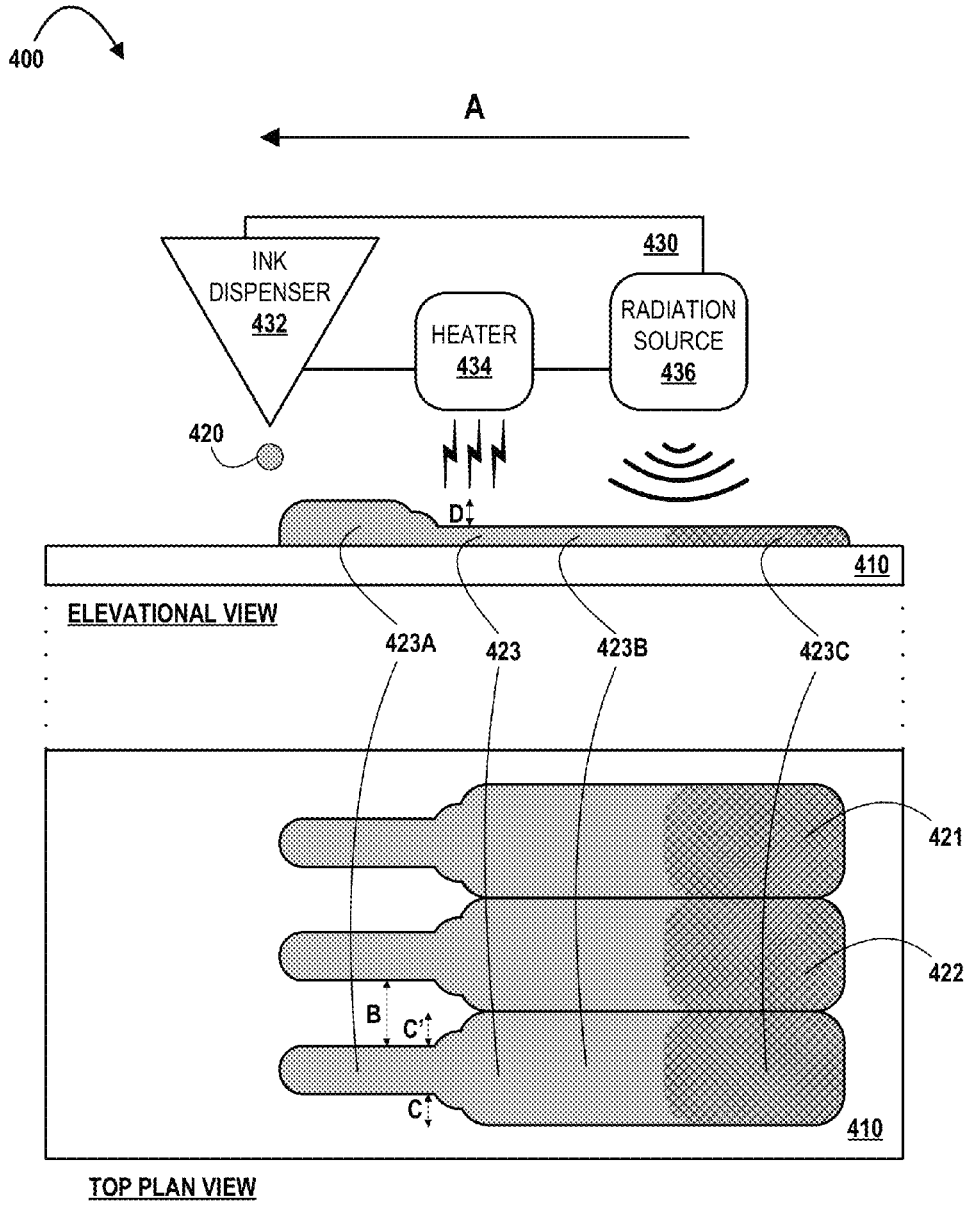
Figure 5:
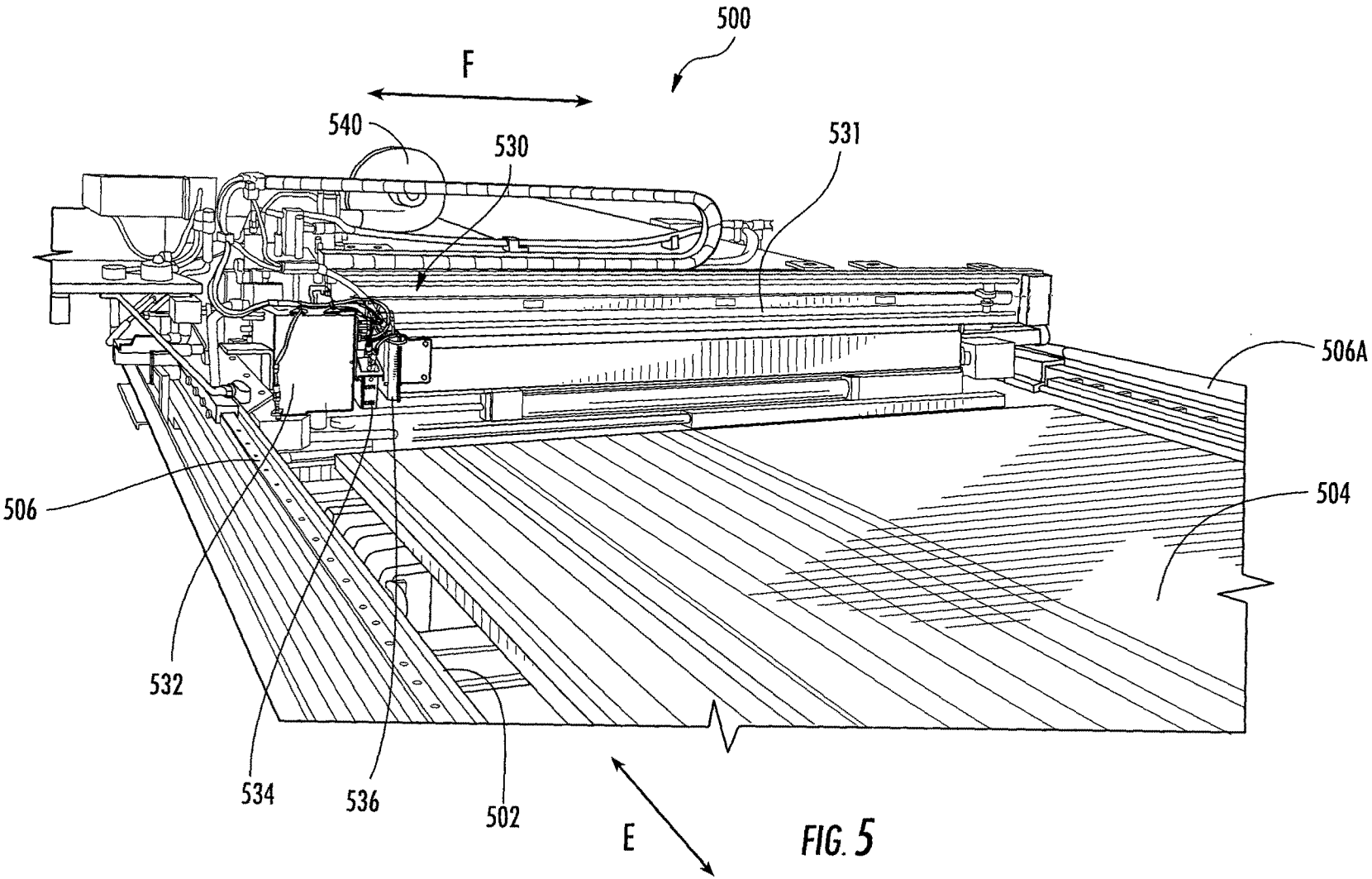
Figure 5A:
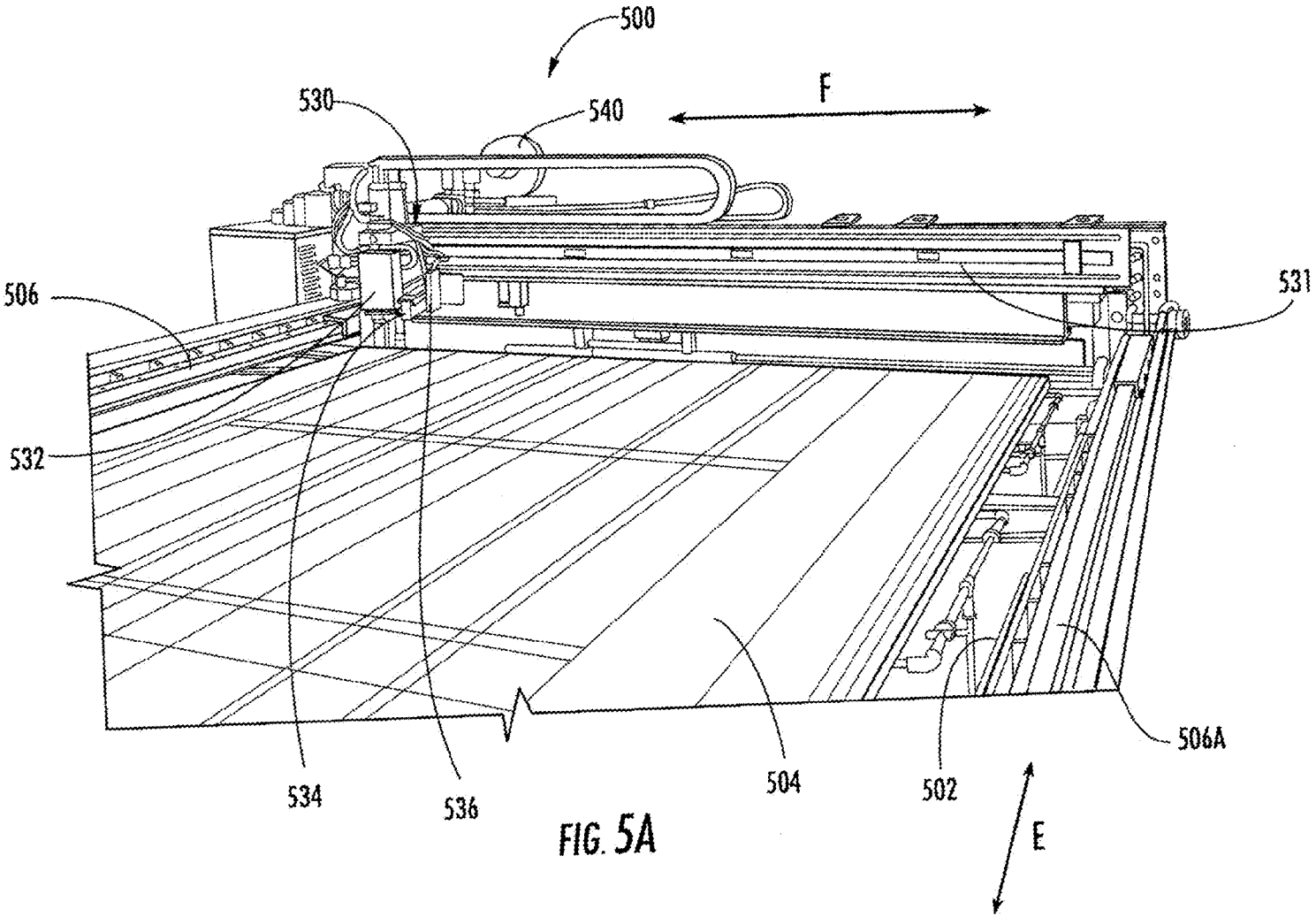
Figure 5B:
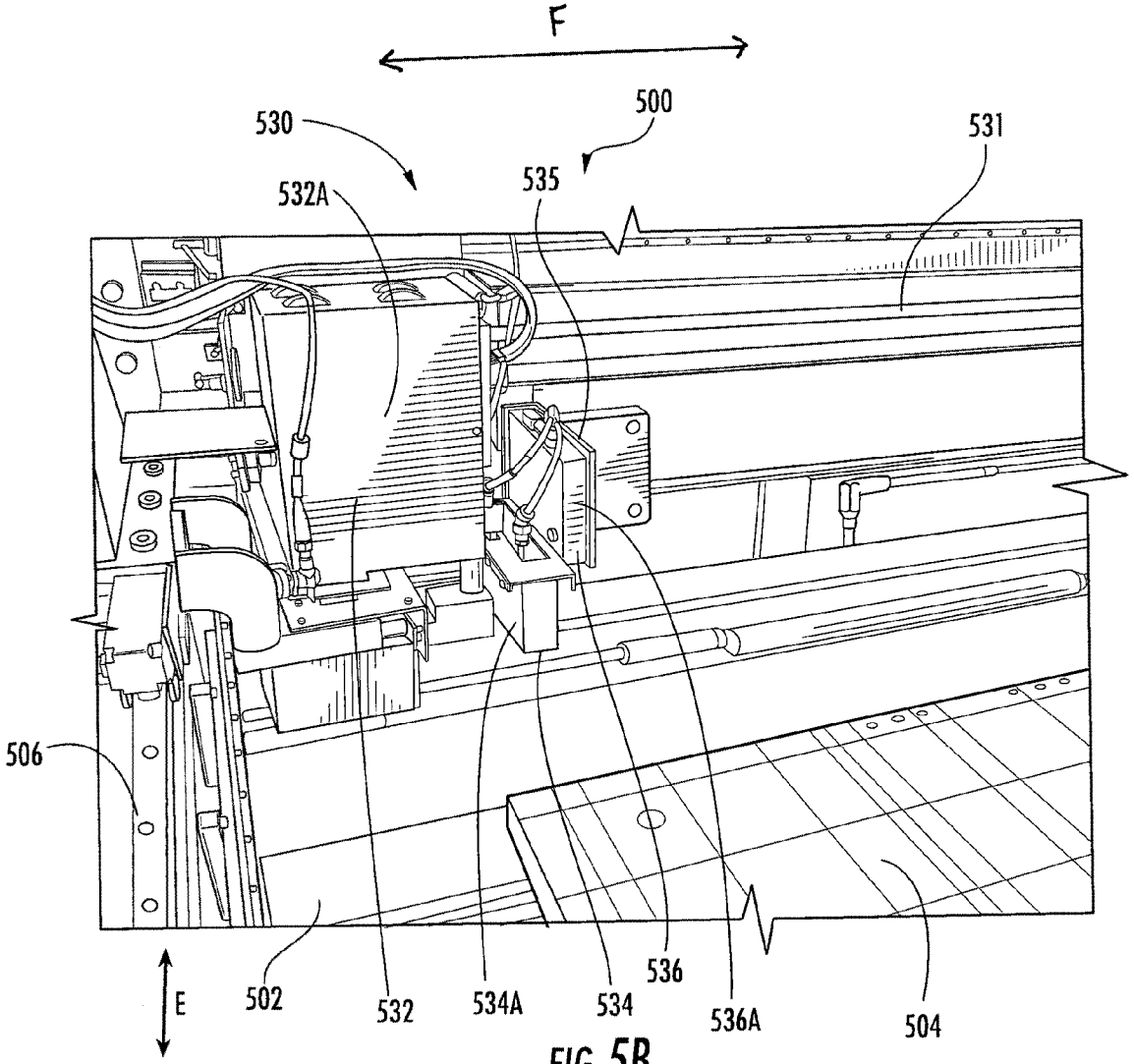
Figure 5C:
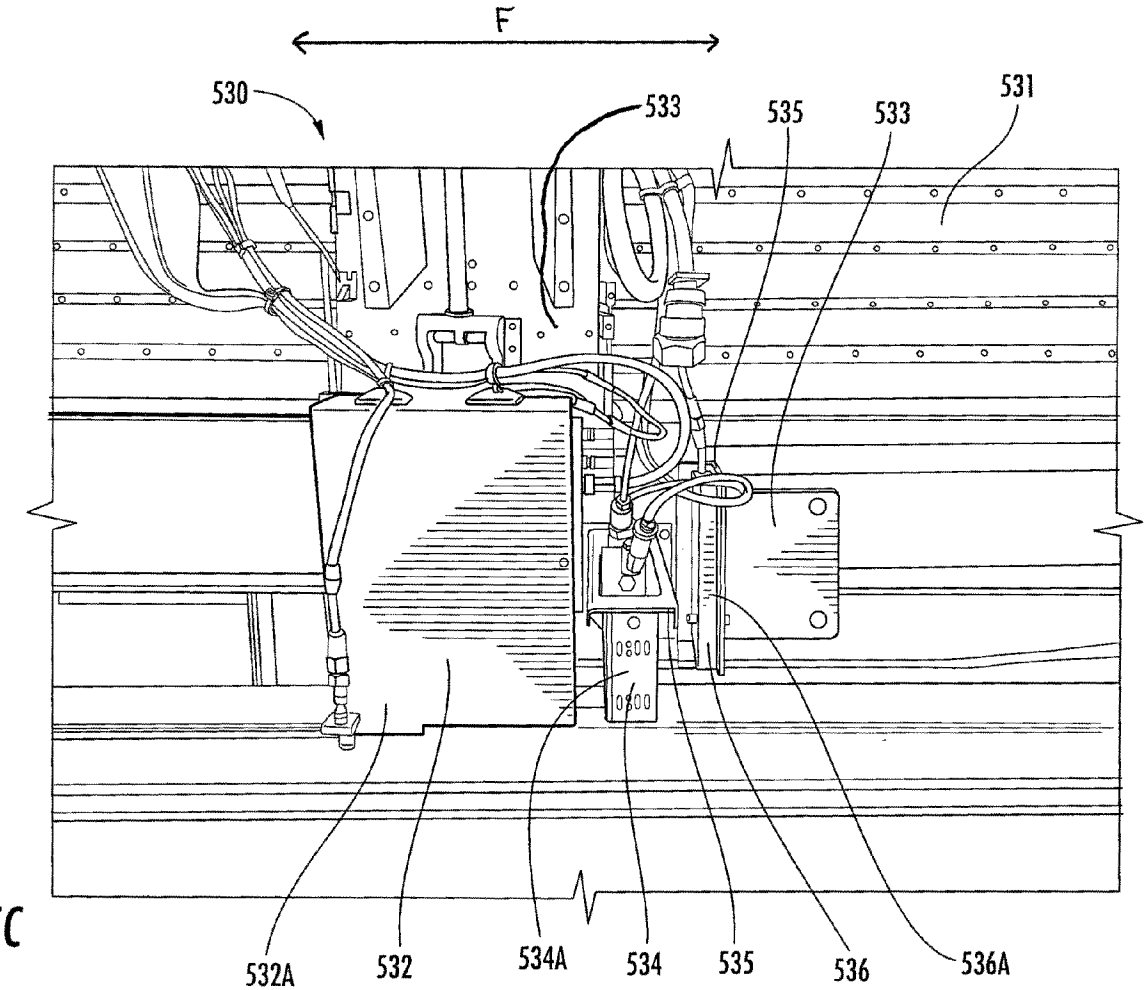
Figure 5D:
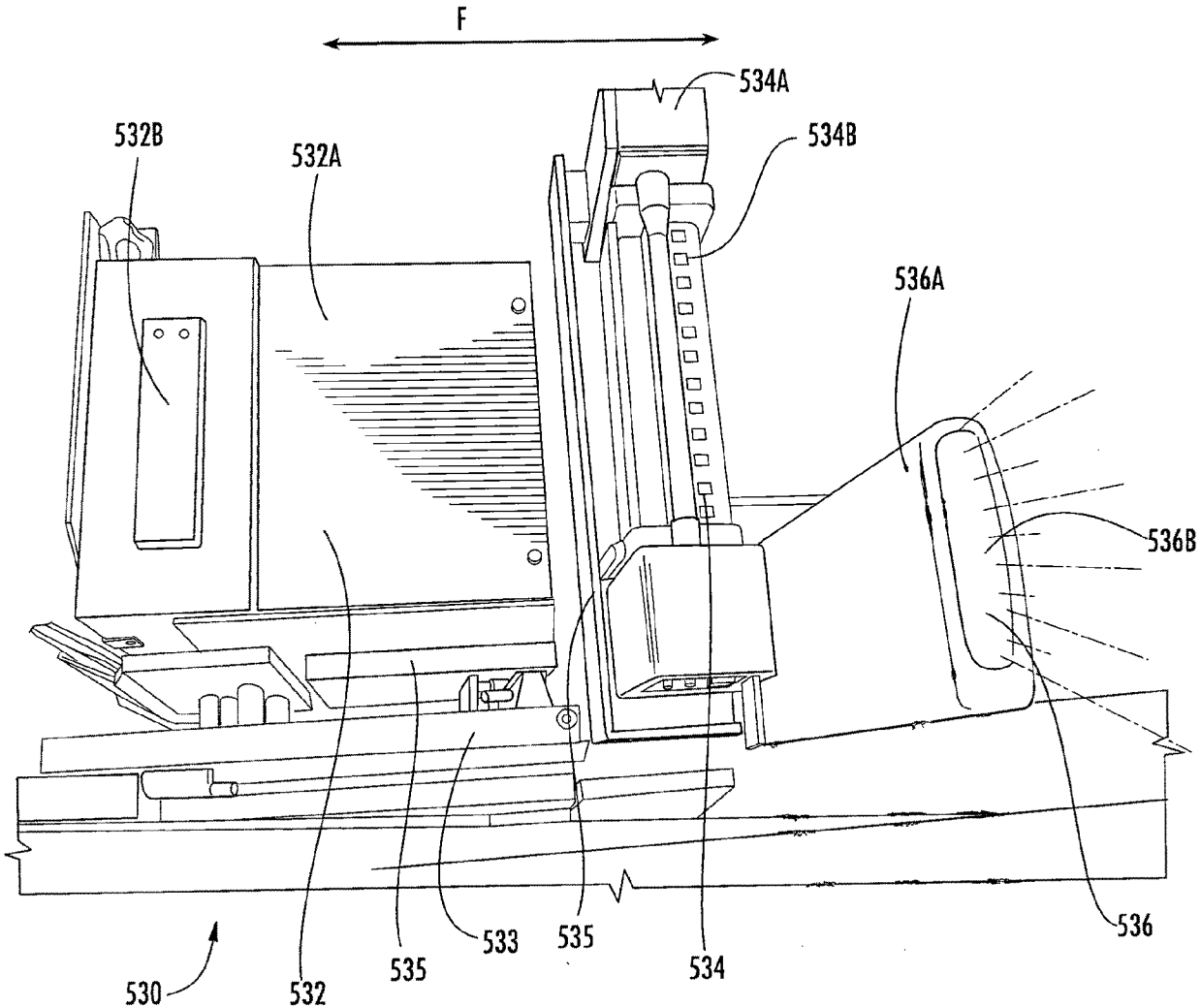
Figure 5E:
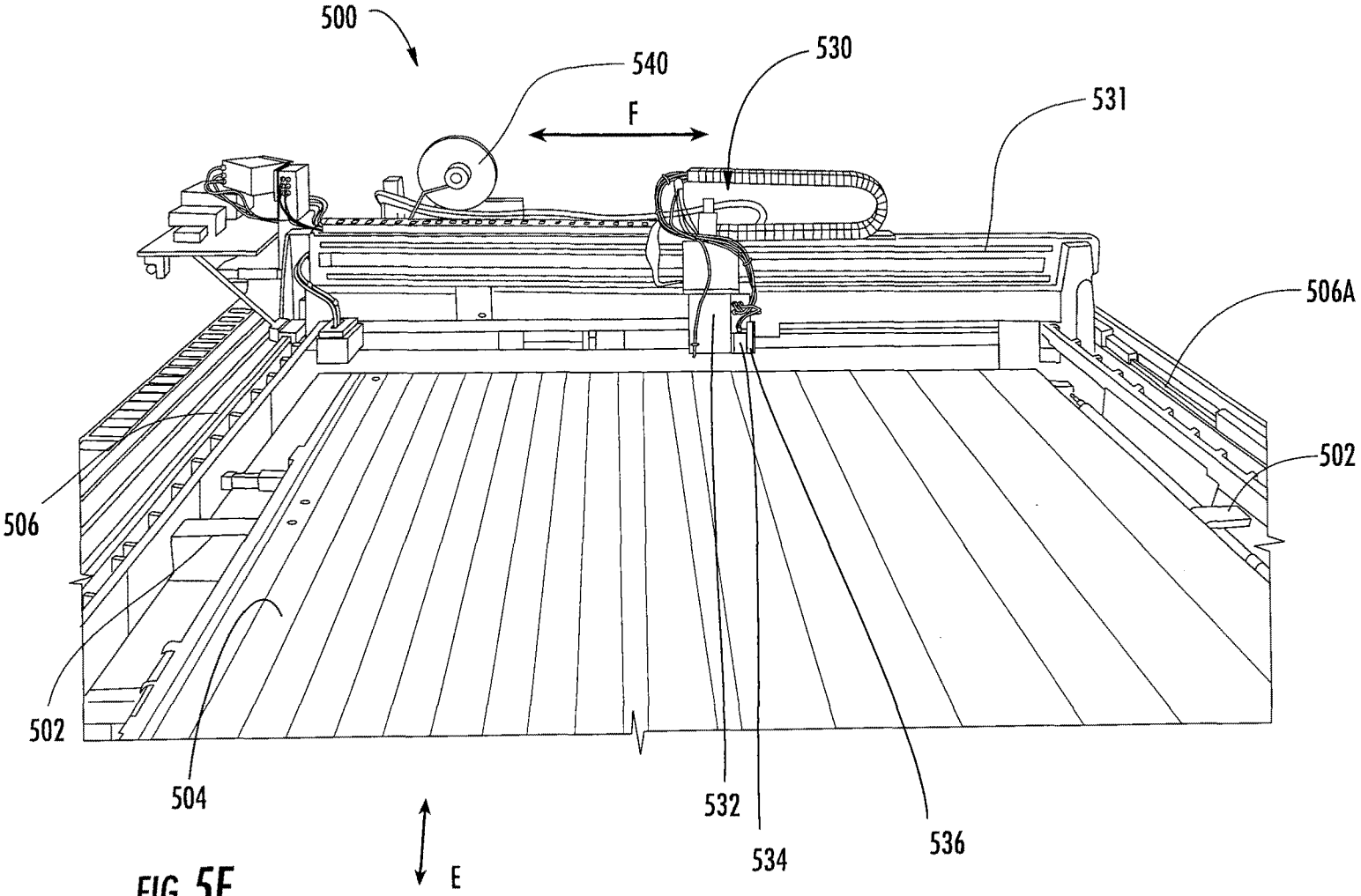
Figure 6:
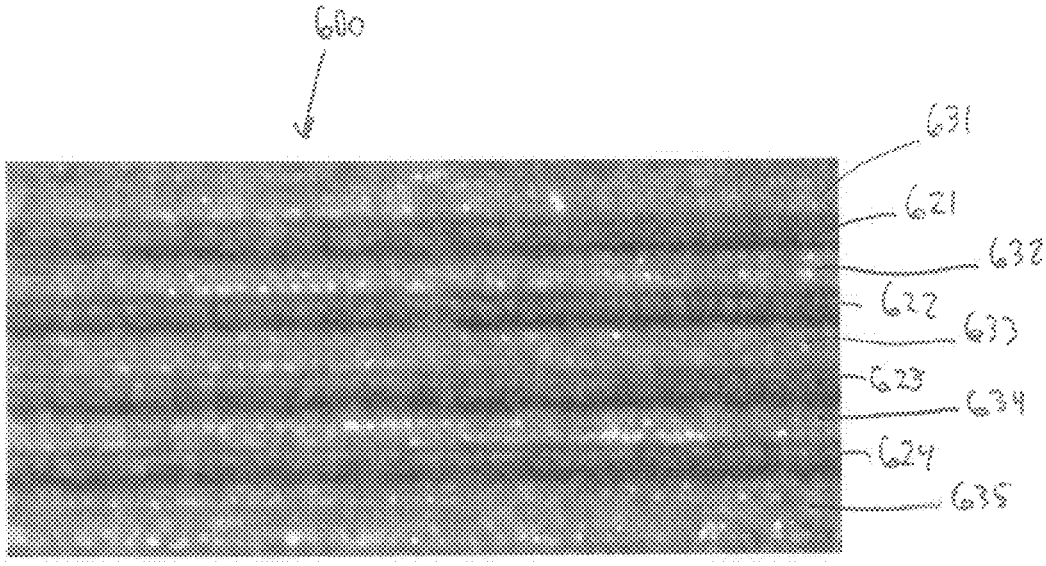
Figure 7:
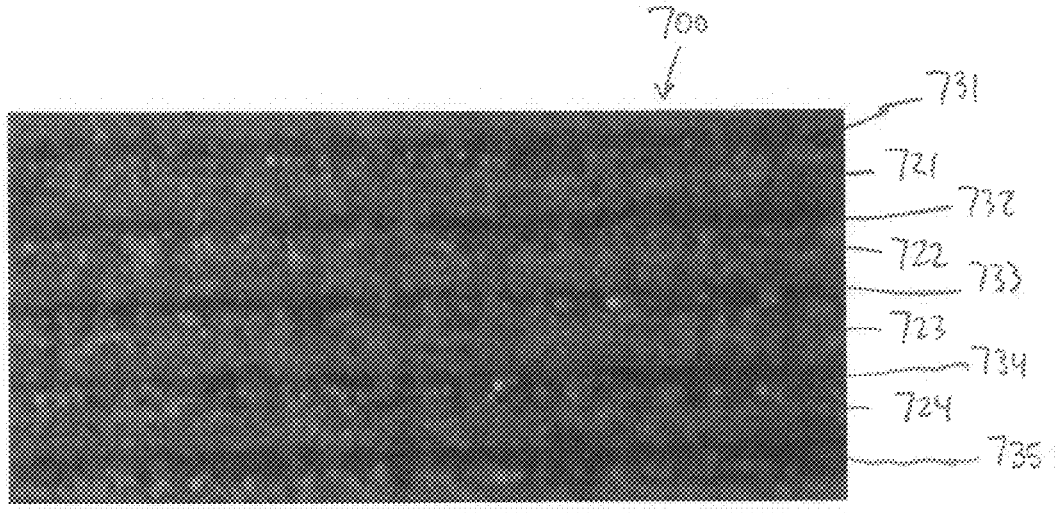

Having thus described some embodiments of the present invention in general terms, reference will now be made to the accompanying figures, which are not necessarily drawn to scale, and where:

FIG. 1 illustrates an exemplary physical low pressure decorative laminate and a physical low pressure press plate system, in accordance with an embodiment of the present invention;

FIG. 2 is a flow diagram illustrating a general process flow for creating a textured press plate (or other textured substrate) by, at least in part, spreading radiation-curable ink over the press plate using a heater, in accordance with an embodiment of the present invention;

FIG. 3 illustrates a top plan, microscopic view of a portion of a press plate having three lines of highly-viscous ink disposed thereon, where the ink lines were not heated or spread after being dispensed onto the press plate;

FIG. 3A illustrates another top plan, microscopic view of the portion of the press plate shown in FIG. 3, where the press plate portion has six lines of highly-viscous ink disposed thereon, and where the ink lines were not heated or spread after being dispensed onto the press plate;

FIG. 4 illustrates elevational and top plan views of a print assembly for dispensing, heating, and irradiating ink on a press plate, in accordance with an embodiment of the present invention;

FIG. 5 illustrates a perspective view of a print apparatus for dispensing, heating, and irradiating ink on a press plate, in accordance with an embodiment of the present invention;

FIG. 5A illustrates another perspective view of the print apparatus shown in FIG. 5, in accordance with that embodiment of the present invention;

FIG. 5B illustrates a perspective view of a print assembly of the print apparatus shown in FIG. 5, in accordance with that embodiment of the present invention;

FIG. 5C illustrates another perspective view of the print assembly shown in FIG. 5B, in accordance with that embodiment of the present invention;

FIG. 5D illustrates a bottom plan view of the print assembly shown in FIG. 5B, in accordance with that embodiment of the present invention;

FIG. 5E illustrates another perspective view of the print apparatus shown in FIG. 5, where the print assembly of the print apparatus is positioned at least partially between the side rails of the print apparatus, in accordance with that embodiment of the present invention;

FIG. 6 illustrates a top plan, microscopic view of a portion of a press plate having four lines of highly-viscous ink disposed thereon, where the ink lines were not heated or spread after being dispensed onto the press plate; and FIG. 7 illustrates a top plan, microscopic view of a portion of a press plate having four lines of highly-viscous ink disposed thereon, where the ink lines were heated and spread after being dispensed onto the press plate, in accordance with an embodiment of the present invention.

DETAILED DESCRIPTION OF EMBODIMENTS OF THE PRESENT INVENTION

Referring now to FIG. 2, a general process flow 200 is provided for creating a textured press plate, and more specifically, for creating a textured press plate by spreading radiation-curable ink over the press plate using a heater, in accordance with an embodiment of the present invention. In some embodiments, one or more (or all) of the portions of the process flow 200 are performed by a press plate manufacturer and/or one or more of the manufacturer's print apparatuses. In such embodiments, the manufacturer precision grinds a press plate (or other substrate) such that the press plate is substantially flat, as represented by block 210. Thereafter, the manufacturer uses a print apparatus (e.g., the print assembly 430 shown in FIG. 4, the print apparatus 500 shown in FIGS. 5-5E, etc.) to print a design on the press plate for guiding a subsequent chemical etching process, as represented by block 220. After the design is properly applied to the press plate, the manufacturer exposes the press plate to a chemical solution (e.g., a ferric chloride solution) to etch the surface portions of the press plate not covered by the ink, as represented by block 230. After etching, the manufacturer may optionally apply a protective layer (e.g., chrome plating) to the newly-textured press plate, as represented by block 240. Thereafter, the press plate manufacturer (and/or some other entity) may use the textured press plate to produce one or more textured decorative laminates, as represented by block 250.

It will be understood that when chemical etching is used to create a textured press plate, as in this example embodiment, the printed design on the press plate determines which surface areas of the press plate will be etched and which will not. As a result, it is imperative that the design be accurately applied to the press plate to prevent incorrect areas from being etched. To assist in this effort, the press plate manufacturer may apply an ink to the press plate that can be at least partially cured and/or fixed onto the press plate, and/or bonded to the press plate, using a radiation source (e.g., UV lamp). By irradiating radiation-curable ink on the surface of the press plate, the manufacturer can ensure that the design applied to the press plate is fixed and not altered before the press plate can be chemically etched.

In addition, the ink used by the press plate manufacturer may have a relatively high viscosity, such that the ink exists as a gel and/or solid at room and/or ambient temperature. This gelling characteristic of the ink can impede and/or prevent the ink from flowing, running, bleeding, and/or otherwise spreading over the press plate after the ink is dispensed onto the press plate. As a result, this characteristic may enable the manufacturer to carefully control the application of ink onto the press plate before the ink is cured. Unfortunately, this same gelling characteristic also slows down the printing process precisely because the highly-viscous ink does not spread over the press plate as quickly as a normal liquid would. As a result, unless the press plate manufacturer is willing to substitute inks and/or modify ink dispensers, the use of a highly-viscous ink will force the manufacturer to run multiple print jobs over the same surface area of the press plate in order to achieve the uniformity and coverage of ink required by the design.

FIGS. 3 and 3A illustrate these challenges in more detail. FIG. 3 shows a top plan view of a portion of an exemplary press plate 310, as viewed through a microscope. The press plate 310 has three lines of radiation-curable ink 321, 322, 323 disposed thereon. Each of the ink lines 321-323 was dispensed onto the press plate 310 from an ink dispenser at the same time, and such that those lines are oriented substantially parallel to each other. However, none of the ink lines 321-323 were heated or spread over the press plate 310 after being dispensed.

In addition, the ink dispensed onto the press plate 310 is highly viscous, such that the ink exists as a gel and/or solid at room and/or ambient temperature. As a result, the ink needed to be heated to a predetermined temperature (e.g., approximately 65-75 degrees Celsius) to properly jet onto the press plate 310 from the ink dispenser. However, after the heated ink contacted the cooler (e.g., room temperature) press plate 310, the ink cooled and/or gelled relatively quickly without spreading into the spaces 324, 325 that exist between the ink lines 321-323. This gelling process also caused the formation of a plurality of "ridges" and/or "valleys" on the press plate 310, where the ink lines 321-323 and/or centers of the ink lines (e.g., the center 321A of ink line 321) represent the ridges and the spaces 324, 325 and/or the sides of the ink lines (e.g., the sides 321B of ink line 321) represent the valleys. It will be understood that, in some embodiments, these ridges have a height dimension (e.g., coming out of the page of FIG. 3) that is greater than the height dimensions of the valleys.

In some embodiments, the distance from the top of the center 321A of the ink line 321 to the surface of the press plate 310 (e.g., in the space 324) is approximately 18 microns. Additionally or alternatively, in some embodiments, the center 321A of the ink line 321 has a height dimension that is greater than the height dimensions of the sides 321B of the ink line 321. In some embodiments, this height difference is approximately 12 microns, i.e., the top of the center 321A is approximately 12 microns taller than the tops of the sides 321B. Thus, it will be understood that, in this example embodiment, the ink that has been dispensed onto the press plate 310 is not level and/or uniformly distributed over the press plate 310. Assuming that the press plate manufacturer does not want to adjust the print heads so that they are spaced more closely together, and assuming that the manufacturer does not want to substitute the highly-viscous ink for a less-viscous ink, the manufacturer may be forced to perform one or more additional print jobs—as shown in FIG. 3A—to adequately cover the spaces 324, 325. Without these additional print jobs, the inadequate amount of ink in the spaces 324, 325 will erode during the chemical etching process and/or cause those spaces 324, 325 to be incorrectly etched.

FIG. 3A shows another top plan view of the portion of the press plate 310, as viewed through a microscope, after three additional lines of ink 326, 327, 328 have been dispensed thereon to cover the spaces 324, 325. As shown, the ink line 326 is positioned between the ink lines 321, 322; the ink line 327 is positioned between the ink lines 322, 323; and the ink line 328 is positioned such that ink line 323 is positioned between the ink lines 325, 326. All of the ink lines 321, 322, 323, 326, 327, 328 have been dispensed so that they are substantially parallel to each other, and so that each has a similar width.

Of course, this additional print job is not preferred, as it requires the use of additional ink (e.g., twice as much ink as compared to a single print job) and results in a longer printing process. In addition, the ink lines 321-323, 326-328 may be embodied as relatively uneven and/or "bumpy" ridges of ink on the press plate 310, meaning that those ink lines may not be suitably level and/or distributed over the press plate 310 for the etching process.

To overcome these particular challenges and other challenges posed by using highly-viscous ink, a press plate manufacturer can utilize one or more embodiments of the present invention. More specifically, with reference to the process flow 200 shown in FIG. 2, the manufacturer can print the design on the press plate by using a print apparatus configured to: (a) dispense radiation-curable, chemical solution-resistant ink onto the press plate (e.g., using an inkjet printer), as represented by block 222; (b) spread the ink over the press plate by heating the ink (e.g., using an IR heater), as represented by block 224; and (c) irradiate the ink (e.g., using an UV lamp) such that the ink is at least partially cured and/or fixed, and/or such that the spreading of the ink is at least partially slowed and/or stopped, as represented by block 226. This heating process enables the press plate manufacturer to use highly-viscous ink to create textured press plates, and also provides many advantages over conventional printing apparatuses and methods, as described in more detail below.

Referring now to FIG. 4, a print system 400 is provided for implementing the portions of the process flow 200 represented by blocks 222, 224, and 226, and/or for overcoming the gelling problems discussed in connection with FIGS. 3 and 3A, in accordance with an embodiment of the present invention. As shown, FIG. 4 includes a press plate 410, ink 420 (e.g., including lines of ink 421, 422, 423), and a print assembly 430. The print assembly 430 includes an ink dispenser 432, a heater 434, and a radiation source 436. As shown, the print assembly 430 is positioned over the press plate 410, is moving over the press plate 410 in the direction A (e.g., from right to left in FIG. 4), and is dispensing, heating, and irradiating ink 420. To illustrate this process in sufficient detail, two views of the press plate 410 are provided in FIG. 4, a top plan view and an elevational view. It will be understood that the press plate 410 shown in the elevational view is the very same press plate 410 shown in the top plan view, and that the elevational and top plan views show the press plate 410 at the same moment in time. Also, the print assembly 430 is not shown in the top plan view for simplicity, even though the print assembly 430 is in fact positioned over the press plate 410 and the lines of ink 421-423 at that moment in time.

In some embodiments, the press plate 410 shown in FIG. 4 is rigid, metallic, and/or does not absorb the ink 420 (and/or any other ink and/or liquid). For example, in some embodiments, the press plate 410 is at least partially or entirely made from stainless steel, such as, for example, 410- or 630-grade hardened stainless steel. In addition, in some embodiments, the press plate 410 is maintained at room (e.g., ambient) temperature (e.g., 24 degrees Celsius) while the ink 420 is being dispensed, heated, and/or cured thereon. Of course, it will be understood that the press plate 410 shown in FIG. 4 is not drawn to scale, as a press plate is typically much larger (e.g., longer, wider) than, for example, an ink dispenser used to dispense ink onto the press plate. Indeed, typical press plates have a height of 2.5 mm to 7 mm and a surface area size from 2.5 m×1.25 m to 6 m×2.25 m, whereas typical print assemblies have smaller surface areas. Also, although much of the present disclosure is directed to dispensing, heating, and curing ink on a press plate, it will be understood that embodiments of the present invention can, where possible, be used in connection with any other type of substrate. For example, instead of a metallic press plate, some embodiments of the present invention are directed to dispensing, heating, and/or irradiating ink on a flexible, non-rigid, and/or ink-absorbing substrate, such as, for example, a plastic or paper-based substrate.

In some embodiments, the ink 420 is a radiation-curable, non-solvent, chemical solution-resistant, and/or highly-viscous ink, such as, for example, the 4601 Black UV ink produced by Markem Corporation of Keene, N.H., USA. In some embodiments, the ink 420 is the same ink discussed in connection with FIGS. 2, 3, and/or 3A. Further, in some embodiments, the ink 420 is sufficiently viscous at room temperature that it must be heated to a predetermined temperature (e.g., approximately 65-75 degrees Celsius) to properly jet onto the press plate 410 from the ink dispenser 432. When heated, the ink 420 may change from a solid and/or gelatinous phase into a liquid phase that is suitable for dispensing and/or flowing. After being dispensed, the heated ink 420 contacts the cooler (e.g., room temperature) press plate 410 and changes back into a solid and/or gelatinous phase. In some embodiments, the ink 420 sits on the surface of the press plate 410 and/or does not penetrate into the press plate 410. In addition, in some embodiments, the ink 420 is designed to at least partially cure and/or be fixed on the press plate 410 when radiation (e.g., UV radiation) is applied to the ink 420 after the ink 420 is dispensed onto the press plate 410.

In some embodiments, the ink 420 is UV-curable but not IR-curable. Also, in some embodiments, the ink 420 is configured to resist a chemical solution (e.g., ferric chloride solution) during a chemical etching process. Additionally or alternatively, after being dispensed onto the press plate 410, the ink 420 may provide a water-resistant and/or waterproof layer on top of the press plate 410. Additionally or alternatively, in some embodiments, the ink 420 is not a water-based ink, and/or is not a solvent-based ink.

As shown in FIG. 4, the print assembly 430 includes the ink dispenser 432, heater 434, and radiation source 436. In some embodiments, each of these components is fastened, bolted, mounted, and/or otherwise connected to the print assembly 430 (e.g., directly and/or via one or more mounts and/or brackets). As shown, the heater 434 is positioned on the print assembly 430 at least partially between the ink dispenser 432 and the radiation source 436. The ink dispenser 432 is positioned on a front portion of the print assembly 430, and the radiation source 436 is positioned behind the ink dispenser 432 on a rear portion of the print assembly 430.

As shown, the press plate 410 is stationary, and the print assembly 430 is configured to move back and forth over and/or relative to the press plate 410, so that, for example, the print assembly 430 can ink, heat, and/or irradiate one or more (or all) surface portions of the press plate 410. However, in other embodiments not shown, the print assembly 430 is stationary and a press plate is moved underneath and/or relative to the print assembly 430. In some embodiments, as shown in FIG. 4, the print assembly 430 can travel over the press plate 410 and perform its dispensing, heating, and irradiating functions continuously, continually, and/or simultaneously. Additionally or alternatively, the ink dispenser 432, heater 434, and radiation source 436 can travel over the press plate 410 together, at the same speed, in tandem, simultaneously, continuously, and/or in one motion. Also, the ink dispenser 432, heater 434, and radiation source 436 can travel over a particular surface portion of the press plate 410—and/or perform their respective functions—in order. In other words, as shown in FIG. 4, the ink dispenser 432 can pass over a particular surface portion of the press plate 410 first and dispense ink 420 thereon; the heater 434 can pass over that surface portion second and heat and spread the ink 420 disposed thereon; and then the radiation source 436 can pass over that surface portion third (and last) and at least partially cure the ink 420 disposed thereon.

In some embodiments, the print assembly 430 is configured to move relatively quickly over the press plate 410. For example, the print assembly 430 may be configured to move over the press plate 410 at a speed of approximately 100-500 millimeters per second (mm/s) (e.g., at a speed of approximately 200 mm/s). In some embodiments, the print assembly 430 is configured such that, for example, the heater 434 passes over a particular surface portion of the press plate 410 no later than approximately 0.1-5 seconds after the ink dispenser 432 has passed over that same portion. For example, in some embodiments, the heater 434 applies heat to ink approximately one second after that ink has been dispensed from the ink dispenser 432. In addition, in some embodiments, the print assembly 430 is configured such that the radiation source 440 passes over a particular portion of the press plate 410 no later than approximately 500 milliseconds after the heater 434 has passed over that same portion. For example, in some embodiments, the radiation source 436 applies radiation to ink approximately 380 milliseconds after that ink has been heated by the heater 434. Accordingly, in some embodiments, the radiation source 440 can irradiate ink disposed on the press plate 410 not more than, for example, one and a half seconds after the ink dispenser 432 has dispensed that ink.

The ink dispenser 432 may include any number and/or type of ink dispenser(s). In some embodiments, the ink dispenser 432 is embodied as a digital, computer, and/or inkjet printer configured to dispense ink via one or more print heads. For example, in some embodiments, the ink dispenser 432 is embodied as a SureFire 4000 inkjet printer made by Markem Corporation. In some of these embodiments, the printer has a single print head thereon, which is embodied as a Spectra® Galaxy JA 256/30 AAA print head made by Fujifilm Dimatix, Inc. of Santa Clara, Calif., USA. This print head has 256 nozzles thereon, and the nozzles are arranged in a single line with an approximate 200-300 micron distance (e.g., 254 micron distance) between each nozzle. Each nozzle can have a diameter of approximately 30-40 microns (e.g., 36 microns), and/or the nozzles can be fired simultaneously or individually. In addition, the nozzles and/or print head can dispense approximately 10,000-20,000 drops of ink per second (e.g., 16,000 drops of ink per second), and the print head has a resolution capability of approximately 200-1000 dots per inch (dpi) (e.g., 600 dpi). In addition, the inkjet printer and/or print head can be configured to operate continuously, and/or can be controlled to operate at a predetermined output rate.

In some embodiments, the ink dispenser 432 is configured to heat the ink 420 before dispensing it onto the press plate 410. Indeed, in some embodiments, the relatively high viscosity of the ink 420 at room temperature makes it difficult and/or impossible to dispense that ink 420 via the ink dispenser 432 without first heating the ink 420. In such embodiments, the ink dispenser 432 may include a heater (not shown) that is positioned on and/or near, and/or built into, the ink dispenser 432. In some embodiments, that heater is configured to heat the ink 420 to a predetermined temperature so that the ink 420 can be forcibly jetted onto the press plate 410 via the one or more print heads. For example, in some embodiments, the ink dispenser 432 and/or its heater is configured to heat the ink 420 to approximately 65-75 degrees Celsius (e.g., 68 degrees Celsius) in order to change the ink 420 from a gel and/or solid into a liquid suitable for dispensing. It will be understood that any number and/or type of heater may be used to heat the ink prior to dispensing it via the ink dispenser 432.

The heater 434 may include any number and/or type of heater(s). In some embodiments, the heater 434 is embodied as an IR heater, non-contact heater, thermal heater, heat plate, ceramic heating element, and/or heat lamp. The heater 434 may be configured to emit IR radiation (e.g., 0.74-300 micrometers in wavelength), thermal radiation, and/or heat, and/or to transmit IR radiation, thermal radiation, and/or heat to the ink 420 and/or to the press plate 410. In some embodiments, the press plate 410 is maintained at room and/or ambient temperature, and the heater 434 is configured to directly heat the ink 420 disposed on the press plate 410. However, in other embodiments not shown, the heater 434 is configured to heat or pre-heat the press plate 410. In other words, in such embodiments, the heater 434 may directly heat the press plate 410 instead of the ink 420, such that the ink 420 is heated indirectly and/or by virtue of being disposed on the heated press plate 410.

In some embodiments, the heater 434 is embodied as a StripIR® Model 5306B IR heater made by Research Inc. of Eden Prarie, Minn., USA. Additionally or alternatively, in some embodiments, the heater 434 is configured to output heat at a temperature of approximately 1300-1500 degrees Fahrenheit (e.g., 1400 degrees Fahrenheit). The heater 434 may be configured to reach approximately 80-95 percent (e.g., approximately 90 percent) of its full operating temperature and/or maximum heat output within approximately 5 seconds (e.g., in approximately 3 seconds or less) of a cold start. Thus, it will be understood that the heater 420 can be configured to quickly and/or efficiently heat and/or transfer heat to the ink 420 and/or press plate 410. Also, in some embodiments, the heater 434 is configured to dissipate to approximately 5-15 percent (e.g., to approximately 10 percent) of its maximum operating temperature and/or maximum heat output within approximately 3-8 seconds (e.g., in approximately 5 seconds or less) after its power supply is disconnected. In addition, the heater 434 can be configured to operate continuously, and/or can be controlled to operate at a predetermined temperature and/or output a predetermined amount of heat. In some embodiments, the heater 434 includes a specular, water-cooled, and/or aluminum reflector and one or more ceramic, end-seal, short wavelength, quartz, halogen, and/or T3 lamps. In some of these embodiments, the one or more lamps are rated at approximately 200-300 volts (e.g., approximately 240 volts). Also, in some embodiments, the lamps have a length and/or heated length of approximately 2-38 inches (e.g., approximately 5 inches).

In addition, the heater 434 can be configured to heat the ink 420 to a predetermined temperature (e.g., approximately 65-75 degrees Celsius) such that the ink 420 melts (e.g., changes from a solid and/or gel into a liquid), levels, flows, and/or spreads over the press plate 410 (i.e., over one or more portions of the press plate 410, which is not necessarily the entire press plate 410). In some embodiments, the heater 434 is configured to heat the ink 420 and/or the press plate 410, such that the ink 420 melts in under one second (e.g., melts in approximately 250 milliseconds). Also, in some embodiments, the heater 434 is configured to heat the ink 420 and/or the press plate 410, such that the surface area of the press plate 410 covered by the ink 420 increases by approximately 15-20% (due to the ink 420 spreading). In some embodiments, the spreading of the ink 420 over the press plate 410 is limited by the volume and/or amount of ink 420 originally dispensed onto the press plate 410 by the ink dispenser 432.

It will be understood that, in some embodiments, the ink 420 is spread and/or leveled over the press plate 410 solely by using the heater 420 and not, for example, by dispensing additional ink, by pressurizing the ink 420, or by contacting the ink 420 with a leveling roller or some other mechanical device. Additionally or alternatively, in some embodiments, the heater 434 is not used for any purpose other than to heat and/or spread the ink 420 over the press plate 410. For example, in some embodiments, the heater 434 is not used to reduce the gloss of the design printed on the press plate 410. As another example, in some embodiments, the heater 434 is not used to cure the ink 420; in other words, the ink 420 may not be IR-curable ink. As still another example, in some embodiments, the heater 434 is not used to dry or harden the ink 420; instead, the ink 420 is solid and/or gelatinous at room temperature, and the heater 434 is a used to melt, level, and/or spread the ink 420 over the press plate 410.

The radiation source 436 may include any number and/or type of radiation source(s). In some embodiments, the radiation source 436 is embodied as a UV radiation source, which may include, for example, one or more black lights, UV LED lamps, mercury bulbs, and/or other kinds of UV lamps. In some embodiments, the ink 420 is embodied as a UV-curable ink, and the radiation source 436 is embodied as a UV lamp configured to emit UV radiation and/or UV light (e.g., 150-450 nm in wavelength) to the ink 420 and/or the press plate 410. Additionally or alternatively, in some embodiments, the radiation source 436 is configured to irradiate the ink 420 so that the ink 420 is at least partially cured, fully cured, and/or fixed on, and/or bonded to, the press plate 410, and/or so that the spreading of the ink 420 (e.g., caused by the heater 434) over the press plate 410 is at least partially slowed and/or stopped. In some embodiments, the radiation source 436 emits a first type of radiation, and the heater 434 emits a second type of radiation, where the first type of radiation is different than the second type (e.g., the first type has a different wavelength than the second type, the first type affects the ink differently than the second type, the first type is UV radiation whereas the second type is IR radiation, etc.).

In some embodiments, the radiation source 436 includes two separate radiation sources, which may be of any type. In some of these embodiments, the first radiation source is configured to partially cure the ink 420 (e.g., after the ink 420 is heated by the heater 434), and the second radiation source is configured to fully cure the ink 420 (e.g., after the ink 420 is partially cured by the first radiation source). For example, in some embodiments, the first radiation source is configured to output UV light in the approximately 380-420 nm range and/or output approximately 50-100 total peek irradiance (e.g., approximately 83.21 total peek irradiance). Also in such embodiments, the second radiation source is configured to output UV light in the approximately 200-400 nm range and/or output approximately 5000-6000 total peek irradiance (e.g., approximately 5875 total peek irradiance). As a specific example, in some embodiments, the first radiation source is embodied as a Phoseon® FireEdge 75×5 LED UV lamp made by Phoseon Technology of Hillsboro, Oreg., USA. As another specific example, in some embodiments, the second radiation source is embodied as a Fusion 300 UV lamp made by Dymax Corporation of Torrington, Conn., USA. The first and/or second radiation sources can each be configured to operate continuously, and/or can be controlled to operate at a predetermined output rate.

In some embodiments, the first radiation source and the second radiation source are arranged on separate print assemblies, whereas in other embodiments, they are arranged on the same print assembly 430. For example, in some embodiments, the first radiation source is positioned on the same side of the print assembly 430 as the ink dispenser 432 and heater 434, whereas the second radiation source is positioned on the opposite side of the print assembly 430 (e.g., the back of the print assembly 430, which is not shown in FIG. 4). Of course, in other embodiments, the first and second radiation sources may be positioned on the same side of the print assembly 430. In addition, in some embodiments, the first radiation source is configured to partially cure to the ink 420, after the ink 420 is heated by the heater 434, so that the ink 420 is slowed from and/or stops spreading over the press plate 410. In some of these embodiments, the second radiation source is configured to fully cure the partially-cured ink 420 so that the ink 420 is fixed and/or bonded to the press plate 410 and/or so that the printed design will not be altered before the press plate 410 can be etched.

In operation, the print assembly 430 is configured to move back and forth over the press plate 410 in order to dispense, heat, and irradiate the ink 420. As shown in the top plan view of FIG. 4, the ink dispenser 432 has dispensed nearly three full lines of ink 421, 422, 423 onto the shown portion of the press plate 410. In addition, the heater 434 has already melted, leveled, and/or spread a portion of each line of ink 421-423 over the press plate 410. Further, the radiation source 436 has already at least partially cured a portion of each line of ink 421-423, which is represented in FIG. 4 by the pattern applied to the right-most portions of ink lines 421-423. Accordingly, it will be understood that FIG. 4 illustrates the print assembly 420 in the process of dispensing, heating, and irradiating the ink lines 421-423. To explain this in more detail, reference will now be made to ink line 423, although it will be understood that the ink lines 421 and 422 are being treated similarly.

As shown, the third ink line 423 includes three portions 423A, 423B, 423C, where each portion represents how the ink 420 in the ink line 423 reacts to each stage in the process. The first portion 423A represents how the ink 420 gels on the surface of the press plate 410 immediately after being dispensed from the ink dispenser 432. The top plan and elevational views of FIG. 4 cooperate to show how the first portion 423A has formed a relatively narrow, tall, and/or concentrated ridge of ink that has not spread over the surface of the press plate 410 as a liquid normally would. As shown, the combination of this ridge with the corresponding ridge in ink line 422 leaves a space having a width B between those ink line portions.

The second portion 423B of the third ink line 423 represents how the ink 420 has melted, leveled, and/or spread over the press plate 410 as a result of being heated by the heater 434. Specifically, as shown in the top plan view, the width of the second portion 423B is greater than the width of the first portion 423A. This difference in width is indicated in the top plan view by the combination of the widths C and C'. (In some embodiments, the combination of the widths C and C' equals the width B of the space between the ink lines 422 and 423.) In some embodiments, the heater 434 is configured to heat the ink 420 so that the value of the widths C and C' are each at least approximately 1-10 microns. Given a constant length dimension, the surface area of the press plate 410 covered by the second portion 423B of the ink line 423 is greater than the surface area covered by the first portion 423A. Indeed, in some embodiments, the heater 434 is configured to heat the ink 420 so that the surface area covered by the second portion 423B is approximately 15-20% greater than the surface area covered by the first portion 423A.

The elevational view of FIG. 4 also shows how the ink 420 has melted, leveled, and/or spread over the press plate 410 as a result of being heated by the heater 434. Specifically, the height of the second portion 423B of the third ink line 423 is less than the height of the first portion 423A. This difference in height is indicated in the elevational view by the height D. In some embodiments, the heater 434 is configured to heat the ink 420 so that the value of D is approximately 5-6 microns. Thus, the heater 434 can be configured to reduce, level, smooth, and/or flatten the concentrated ridge of ink exemplified by the first ink portion 423A down to the smaller ridge of ink exemplified by the second ink portion 423B. In so doing, the heater 434 spreads the ink 420 out over the surface area of the press plate 410, which results in a greater surface area of the press plate 410 being covered than if no heat was applied at all. (Again, it will be understood that the dimensions of the ink lines 421-423 shown in FIG. 4 are not necessarily drawn to scale; rather, these ink lines are drawn to represent how they have been affected by the print assembly 430).

Thus, the use of the heater 434 on the print assembly 430 overcomes many of the challenges posed by using highly-viscous ink to create textured press plates. First, the use of the heater 434 saves ink. Because the ink 420 is heated and spread over the press plate 410, the press plate manufacturer may not need to run the one or more additional print jobs that would otherwise be required to cover the spaces created by using the highly-viscous ink 420. In other words, the use of the heater 434 enables the print assembly 430 to cover more of the surface area of the press plate 410 with ink 420 than if the print assembly 430 did not use the heater 434 at all.

In addition to saving ink, the use of the heater 434 saves time. For example, where the heater 434 is an IR heater rated at 1400 degrees Fahrenheit, where the ink 420 is 4601 Black UV ink produced by Markem, and where the press plate 410 is a stainless steel press plate having a surface area of approximately 13.5 square meters, the print assembly 430 is capable of printing a selected design on the press plate 410 in four hours instead of the eight hours that would otherwise be required if the print assembly 430 did not use the heater 434 to spread the ink 420 over the press plate 410. In other words, the use of the heater 434 may cut in half the time required to print the design on the press plate 410, and/or may enable the print assembly 430 to print the design on the press plate 410 in half as many print jobs. In addition to saving ink and time, the use of the heater 434 can also save a press plate manufacturer the trouble of having to substitute, replace, and/or adjust the ink dispenser 432 (e.g., move the print heads on an inkjet printer closer together) to account for the spaces created when the highly-viscous ink 420 gels on the press plate 410. Still further, the use of the heater 434 enables the press plate manufacturer to use the highly-viscous ink 420 without having to substitute it for another ink that may be more suitable for the manufacturer's ink dispenser 432 but less suitable for the etching process.

Still referring to FIG. 4, the third portion 423C of the third ink line 423 has been at least partially cured and/or fixed onto the press plate 410 by the radiation source 436. In FIG. 4, this is represented by the pattern applied to the ink line portion 423C as well as to the corresponding portions of ink lines 421 and 422. In some embodiments, the ink line portion 423C has only been partially cured so that, for example, the spreading of the ink 420 caused by the heater 434 is at least partially slowed and/or stopped. However, in other embodiments, the ink line portion 423C has been fully cured on, and/or bonded to, the press plate 410 so that that portion is at least substantially fixed onto the surface of the press plate 410. It will be understood that the print assembly 430 can be configured to dispense, heat, and partially cure the ink lines 421-423 on the press plate 410 first and then make a second pass over those ink lines later to fully cure them (e.g., using the radiation source 436, using another radiation source not shown, etc.). In some cases, the ink lines 421-423 must be fully cured on the press plate 410 to ensure that the printed design formed from those ink lines is not accidentally altered before the press plate 410 can be chemically etched.

After the design is applied to the press plate 410, the press plate 410 can be etched using a chemical etching process. For example, in some embodiments, the press plate 410 is made of stainless steel (e.g., 410- or 630-grade hardened stainless steel), the press plate 410 is chemically etched using a ferric chloride solution, and the design that is printed on the surface of the press plate 410 is made from the ink 420 that resists the ferric chloride solution. In such embodiments, the ink 420 is dispensed onto the press plate 410, and then the press plate 410 is exposed to the ferric chloride solution, such that the surface areas of the press plate 410 that are not covered in ink 420 are etched, whereas the surface areas that are covered in the ink 420 are not etched.

Of course, it will also be understood that the embodiment illustrated in FIG. 4 is merely exemplary and that other embodiments may vary without departing from the scope and spirit of the present invention. For example, in some alternative embodiments, the ink dispenser 432, the heater 434, and/or the radiation source 436 are not connected to the same, unitary print assembly 430; rather, in some embodiments, these components may be distributed over two or more print assemblies that may be configured to move independently of each other. For example, in some embodiments, the ink dispenser 432 is mounted to a first print assembly, and the heater 434 and the radiation source 436 are mounted to a second print assembly, where the first print assembly is configured to move ahead of and/or at a different speed than the second print assembly. As another example, in some alternative embodiments, the print assembly 430 does not include the radiation source 436 (and/or does not implement the portion of the process flow 200 represented by block 226); instead, after the ink is spread over the press plate 410 using the heater 434, the heater 434 is moved away from the ink 420 to allow the ink 420 to cool normally and re-gel and/or re-solidify on the surface of the press plate 410. In some of these embodiments, the ink 420 is not radiation-curable and is therefore not exposed to radiation (other than any radiation emitted from the heater 434).

Referring now to FIGS. 5-5E, a print apparatus 500 for dispensing, heating, and curing radiation-curable ink is provided, in accordance with an exemplary embodiment of the present invention. It will be understood that, in some embodiments, the print apparatus 500 is configured to implement any one or more portions of any embodiment (e.g., the process flow 200) disclosed and/or contemplated herein. It will also be understood that the print apparatus 500 includes a print assembly 530, which, in some embodiments, is a more-specific embodiment of the print assembly 430 described in connection with FIG. 4.

As shown in FIGS. 5 and 5A, the print apparatus 500 includes a frame 502, a platform 504, a print assembly 530, and a gantry 531. The frame 502 includes a pair of side rails 506, 506A that are positioned such that the platform 504 is located at least partially between the first side rail 506 and the second side rail 506A. The platform 504 is supported by and/or connected to the frame 502, and the platform 504 is configured to at least partially support a press plate (or other type of substrate) thereon.

The gantry 531 is embodied as a lateral rail supported by and/or extending between the first side rail 506 and the second side rail 506A. In some embodiments, the gantry 531 is directly or indirectly supported by and/or connected to the frame 502. In this example embodiment, the gantry 531 is oriented substantially perpendicular to the side rails 506, 506A, but in other embodiments, this orientation may be different. The gantry 531 is configured to carry the print assembly 530 and move back and forth along the side rails 506, 506A in the direction E. Thus, in some embodiments, the gantry 531 is configured to move relative to the side rails 506, 506A. In addition, the print assembly 530 is configured to move back and forth along the gantry 531 in the direction F, so that the print assembly 530 can be positioned over one or more (or all) portions of the platform 504 and/or over a press plate positioned thereon. Thus, in some embodiments, the print assembly 530 is configured to move relative to the gantry 531. In this example embodiment, the direction F is substantially perpendicular to the direction E, but other embodiments may be different.

As shown in FIGS. 5-5E, the print assembly 530 includes one or more mounts 533 (e.g., shown in FIG. 5C), one or more brackets 535, an inkjet printer 532, an IR heater 534, and a partial-cure UV radiation source 536. The inkjet printer 532, the IR heater 534, and the partial-cure UV radiation source 536 are each supported by the bracket(s) 535, which are in turn connected to the mount(s) 533. The mount(s) 533 are connected to the gantry 531 and are configured to move back and forth along the gantry 531 in the direction F. As a result, the entire print assembly 530—including the inkjet printer 532, the IR heater 534, and the partial-cure UV radiation source 536—is configured to move together, simultaneously, in tandem, and/or in order along the gantry 531, in the directions E and/or F, over the platform 504, and/or over a press plate positioned on the platform 504. For example, FIG. 5E shows the print assembly 530 positioned on the gantry 531 approximately halfway in between the side rails 506, 506A.

Referring now to FIGS. 5B-5D, the inkjet printer 532 may be embodied as any inkjet printer described and/or contemplated herein. As shown, the inkjet printer 532 includes a housing 532A and a dispenser slot 532B. In some embodiments, the housing 532A carries an ink reservoir, one or more print heads for dispensing ink from the ink reservoir, and a control system for controlling the dispensing process. The housing 532A is supported by and/or connected to the bracket (s) 535, which are positioned proximate to the back of the housing 532B and/or which are connected to the mount(s) 533. In addition, the housing 532A defines the dispenser slot 532B, which is positioned on the bottom of the housing 532A (shown in FIG. 5D). The dispenser slot 532B defines the area from which ink exits the housing 532A. In some embodiments, the dispenser slot 532B includes one or more nozzles from the one or more print heads of the inkjet printer 532. Also, in some embodiments, the ink held in the ink reservoir and dispensed from the slot 532B is radiation-curable, highly-viscous, and/or resistant to one or more chemical solutions. Additionally or alternatively, in some embodiments, the housing 532A of the inkjet printer 532 includes a heater and/or is configured to heat the ink prior to jetting the ink from the dispenser slot 532B. In some embodiments, this heating is necessary to transform the ink from a gel and/or solid into a liquid suitable for dispensing.

The IR heater 534 may be embodied as any IR heater described and/or contemplated herein. As shown in FIGS. 5B-5D, the IR heater 534 includes a housing 534A and an IR lamp 534B. The housing 534A at least partially houses and/or supports the IR lamp 534B and is connected to and/or supported by the bracket(s) 535. In some embodiments, in addition to being connected to the bracket(s) 535 and/or mount(s) 533, the housing 534A is additionally or alternatively connected to the inkjet housing 532A and/or to the partial-cure UV radiation source housing 536A. The IR lamp 534B is configured to emit and/or transfer heat and/or IR radiation. In some embodiments, the IR lamp 534B is configured to operate at temperatures greater than 1400 degrees Fahrenheit.

The partial-cure UV radiation source 536 may be embodied as any partial-cure UV radiation source described and/or contemplated herein. As shown, the source 536 includes a housing 536A and a UV lamp 536B. The housing 536A at least partially houses and/or supports the UV lamp 536B and is connected to the bracket(s) 535, which are in turn connected to the mount(s) 533. The UV lamp 536B is configured to output, emit, and/or transfer UV radiation and/or light. The UV lamp 536B is also configured to partially cure radiation-curable ink that has been dispensed onto a press plate from the inkjet printer 532. In some embodiments, the partial-cure radiation source 536 and/or UV lamp 536B are configured to partially cure the radiation-curable ink so that the ink stops spreading over the press plate.

In addition to these components, the print apparatus 500 also includes a full-cure UV radiation source 540, which may be embodied as any full-cure UV radiation source described and/or contemplated herein. As shown in FIGS. 5, 5A, and 5E, the full-cure radiation source 540 is positioned on and/or connected to the back side of the gantry 531 (e.g., opposite the print assembly 530). The source 540 also includes a housing 540A and a UV lamp (not shown). The housing 540A at least partially houses and/or supports the UV lamp of the source 540 and is connected to one or more brackets (not shown), which are in turn connected to one or more mounts 533 and/or to the gantry 531. In some embodiments, the UV lamp of the full-cure UV radiation source 540 is configured to output, emit, and/or transfer UV radiation and/or light. The UV lamp of the source 540 is also configured to fully cure radiation-curable ink that has been dispensed onto a press plate by the inkjet printer 532 and/or that has been at least partially cured by the partial-cure UV radiation source 536. In some embodiments, the full-cure UV radiation source 540 and/or its UV lamp are configured to fully cure the partially-cured ink on the press plate so that the ink is fixed to the press plate and/or so that the printed design will not be altered before the press plate can be etched.

In some embodiments, the full-cure UV radiation source 540 is configured to output UV light in the 200-400 nm range and at approximately 5875 total peek irradiance, whereas the partial-cure UV radiation source 536 is configured to output UV light in the 380-420 nm range and at approximately 83.21 total peek irradiance. Further, in some embodiments, the print assembly 530 is configured to use the partial-cure UV radiation source 536 to partially cure the ink dispensed and heated by the print assembly 530 before the full-cure radiation source 540 is used to fully cure that ink, all in preparation for a chemical etching process.

It will be understood that the print assembly 530, inkjet printer 532, IR heater 534, partial-cure UV radiation source 536, and/or full-cure UV radiation source 540 can be connected to one or more power sources. In addition, in some embodiments, one or more portions of the print apparatus 500 (e.g., the full-cure UV radiation source 540, gantry 531, print assembly 530, etc.) are controlled by one or more computers, processors, and/or control systems configured to execute one or more computer-executable program code portions in order to implement any one or more portions of any embodiment described and/or contemplated herein. For example, in some embodiments, the print assembly 530 includes a processor configured to execute one or more program code portions to: (a) dispense ink onto a press plate using the inkjet printer 532, as represented by block 222 of the process flow 200; (b) melt, level, and/or spread the ink over the press plate using the IR heater 534, as represented by block 224; and/or (c) at least partially irradiate the ink using the radiation source 536 (and/or radiation source 540) such that the ink is at least partially cured and/or fixed on the press plate, and/or such that the spreading of the ink over the press plate is at least partially slowed and/or stopped, as represented by block 226.

Referring now to FIGS. 6 and 7, two top plan views of two press plates are shown to illustrate the effects of using—and not using—a heater to spread highly-viscous ink over a press plate, in accordance with some embodiments of the present invention. FIG. 6 illustrates the effects of not using a heater to spread highly-viscous ink over a press plate. Specifically, FIG. 6 shows a microscopic, top plan view of a portion of a press plate 600 that includes a plurality of ink lines 621, 622, 623, 624. These ink lines 621-624 are embodied as relatively narrow, tall, and/or concentrated ridges of ink on the press plate 600, and they do not contact and/or overlap each other. As a result, there are spaces 631, 632, 633, 634, 635 on each side of the ink lines 621-624 where little or no ink is present. As described previously, if these spaces 631-635 are not sufficiently covered in ink, they may be incorrectly etched when the press plate 600 is exposed to a chemical etching process.

On the other hand, FIG. 7 illustrates the effects of using a heater (e.g., the heater 434, the IR heater 534, etc.) to spread highly-viscous ink over a press plate. Specifically, FIG. 7 shows a microscopic, top plan view of a portion of a press plate 700 that includes a plurality of ink lines 721, 722, 723, and 724. As compared to the ink lines 621-624 on the press plate 600, the ink lines 721-724 are relatively wider, shorter, and/or less concentrated with ink. In addition, the ink lines 721-724 contact and/or overlap each other, such that the surface area of the press plate 700 between the ink lines 721 and 724 (including the spaces 731-735 on each side of the ink lines 721-724) are sufficiently covered in ink to avoid being chemically etched.

Although many embodiments of the present invention have just been described above, the present invention may be embodied in many different forms and should not be construed as limited to the embodiments set forth herein; rather, these embodiments are provided so that this disclosure will satisfy applicable legal requirements. Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "one or more," even though the phrase "one or more" is also used herein. Like numbers refer to like elements throughout.

As will be appreciated by one of ordinary skill in the art in view of this disclosure, the present invention may include and/or be embodied as an apparatus (including, for example, a system, machine, device, computer program product, and/or the like), as a method (including, for example, a business method, computer-implemented process, and/or the like), or as any combination of the foregoing. Accordingly, embodiments of the present invention may take the form of an entirely business method embodiment, an entirely software embodiment (including firmware, resident software, microcode, etc.), an entirely hardware embodiment, or an embodiment combining business method, software, and hardware aspects that may generally be referred to herein as a "system." Furthermore, embodiments of the present invention may take the form of a computer program product that includes a computer-readable storage medium having one or more computer-executable program code portions stored therein. As used herein, a processor, which may include one or more processors, may be "configured to" perform a certain function in a variety of ways, including, for example, by having one or more general-purpose circuits perform the function by executing one or more computer-executable program code portions embodied in a computer-readable medium, and/or by having one or more application-specific circuits perform the function.

It will be understood that any suitable computer-readable medium may be utilized. The computer-readable medium may include, but is not limited to, a non-transitory computer-readable medium, such as a tangible electronic, magnetic, optical, electromagnetic, infrared, and/or semiconductor system, device, and/or other apparatus. For example, in some embodiments, the non-transitory computer-readable medium includes a tangible medium such as a portable computer diskette, a hard disk, a random access memory (RAM), a read-only memory (ROM), an erasable programmable read-only memory (EPROM or Flash memory), a compact disc read-only memory (CD-ROM), and/or some other tangible optical and/or magnetic storage device. In other embodiments of the present invention, however, the computer-readable medium may be transitory, such as, for example, a propagation signal including computer-executable program code portions embodied therein.

One or more computer-executable program code portions for carrying out operations of the present invention may include object-oriented, scripted, and/or unscripted programming languages, such as, for example, Java, Perl, Smalltalk, C++, SAS, SQL, Python, Objective C, and/or the like. In some embodiments, the one or more computer-executable program code portions for carrying out operations of embodiments of the present invention are written in conventional procedural programming languages, such as the "C" programming languages and/or similar programming languages. The computer program code may alternatively or additionally be written in one or more multi-paradigm programming languages, such as, for example, F#.

Some embodiments of the present invention are described herein with reference to flowchart illustrations and/or block diagrams of apparatuses and/or methods. It will be understood that each block included in the flowchart illustrations and/or block diagrams, and/or combinations of blocks included in the flowchart illustrations and/or block diagrams, may be implemented by one or more computer-executable program code portions. These one or more computer-executable program code portions may be provided to a processor of a general purpose computer, special purpose computer, and/or some other programmable data processing apparatus in order to produce a particular machine, such that the one or more computer-executable program code portions, which execute via the processor of the computer and/or other programmable data processing apparatus, create mechanisms for implementing the steps and/or functions represented by the flowchart(s) and/or block diagram block(s).

The one or more computer-executable program code portions may be stored in a transitory and/or non-transitory computer-readable medium (e.g., a memory, etc.) that can direct, instruct, and/or cause a computer and/or other programmable data processing apparatus to function in a particular manner, such that the computer-executable program code portions stored in the computer-readable medium produce an article of manufacture including instruction mechanisms which implement the steps and/or functions specified in the flowchart(s) and/or block diagram block(s)

The one or more computer-executable program code portions may also be loaded onto a computer and/or other programmable data processing apparatus to cause a series of operational steps to be performed on the computer and/or other programmable apparatus. In some embodiments, this produces a computer-implemented process such that the one or more computer-executable program code portions which execute on the computer and/or other programmable apparatus provide operational steps to implement the steps specified in the flowchart(s) and/or the functions specified in the block diagram block(s). Alternatively, computer-implemented steps may be combined with, and/or replaced with, operator- and/or human-implemented steps in order to carry out an embodiment of the present invention.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed is:

1. A method for creating a textured press plate that can be used to produce textured decorative laminates, the method comprising:

printing a design on the press plate, wherein the printing comprises:

dispensing ink onto the press plate, wherein the ink stops spreading after the ink comes into contact with the press plate; and after the ink stops spreading, heating, using a heater, the ink until the ink spreads over the press plate; and etching a surface portion of the press plate by exposing the portion to a chemical solution, wherein a first part of the surface portion comprises the ink, the ink preventing the first part of the surface portion from being etched, and wherein the etching occurs after the heating.

2. The method of claim 1, wherein the printing further comprises:

irradiating, using a radiation source, the ink until the ink is at least partially fixed onto the press plate, wherein the etching occurs after the irradiating.

3. The method of claim 1, wherein the chemical solution comprises ferric chloride.

4. The method of claim 1, wherein the printing further comprises:

heating the ink before the dispensing so that the ink comprises a substantially liquid consistency during the dispensing.

5. The method of claim 2, wherein the heater is configured to emit infrared (IR) radiation to heat the ink, and wherein the radiation source is configured to emit ultraviolet (UV) radiation to at least partially fix the ink onto the press plate.

6. A method comprising:

heating radiation-curable ink to a temperature sufficient for dispensing the radiation-curable ink onto a substrate;

dispensing the radiation-curable ink onto a first surface portion of the substrate, the substrate also defining a second surface portion, the substrate being at a temperature sufficient to cool the radiation-curable ink upon contact with the substrate such that the spreading of the radiation-curable ink on the substrate is stopped and such that the radiation-curable ink, upon being dispensed, does not entirely cover the first surface portion;

after the spreading of the radiation-curable ink on the substrate has stopped, heating the radiation-curable ink to a temperature sufficient to cause the radiation-curable ink to spread to increase its coverage of the first surface portion of the substrate;

thereafter, irradiating the radiation-curable ink such that the radiation-curable ink is at least partially cured and prevented from covering the second surface portion of the substrate; and exposing the substrate to a chemical etching solution such that (i) the second surface portion is etched and (ii) the radiation-curable ink resists the chemical etching solution so that the first surface portion covered by the radiation-curable ink is not etched.

7. The method according to claim 6, wherein:

heating radiation-curable ink to a temperature sufficient for dispensing the radiation-curable ink onto a substrate comprises heading the radiation-curable ink to a temperature of at least about 65 degrees Celsius; and heating the radiation-curable ink to a temperature sufficient to cause the radiation-curable ink to spread to increase its coverage of the first surface portion of the substrate comprises heading the radiation-curable ink to a temperature of at least about 65 degrees Celsius.

8. The method according to claim 6, wherein:

heating the radiation-curable ink to a temperature sufficient to cause the radiation-curable ink to spread to increase its coverage of the first surface portion of the substrate occurs within no more than about 1000 milliseconds after dispensing the radiation-curable ink onto the first surface portion of the substrate; and irradiating the radiation-curable ink occurs within no more than about 500 milliseconds after heating the radiation-curable ink to a temperature sufficient to cause the radiation-curable ink to spread to increase its coverage of the first surface portion of the substrate.

9. The method according to claim 6, wherein heating the radiation-curable ink to a temperature sufficient to cause the radiation-curable ink to spread to increase its coverage of the first surface portion of the substrate comprises exposing the radiation-curable ink to thermal radiation.

10. The method according to claim 6, wherein heating the radiation-curable ink to a temperature sufficient to cause the radiation-curable ink to spread to increase its coverage of the first surface portion of the substrate comprises heating the radiation-curable ink to a temperature sufficient to cause the surface area of the radiation-curable ink to increase by between about 15 percent and 20 percent.

11. The method according to claim 6, wherein heating the radiation-curable ink to a temperature sufficient to cause the radiation-curable ink to spread to increase its coverage of the first surface portion of the substrate comprises directly heating the radiation-curable ink to a temperature sufficient to cause the radiation-curable ink to spread to increase its coverage of the first surface portion of the substrate.

12. The method according to claim 6, wherein heating the radiation-curable ink to a temperature sufficient to cause the radiation-curable ink to spread to increase its coverage of the first surface portion of the substrate comprises indirectly heating the radiation-curable ink by heating the substrate to a temperature sufficient to cause the radiation-curable ink to spread to increase its coverage of the first surface portion of the substrate.

13. The method according to claim 6, wherein:

the radiation-curable ink is curable by ultraviolet radiation but is not curable by infrared radiation; and irradiating the radiation-curable ink comprises exposing the radiation-curable ink to infrared radiation.

* * * * *